US009653234B2

(12) United States Patent
Matsumoto

(10) Patent No.: US 9,653,234 B2
(45) Date of Patent: May 16, 2017

(54) MULTIDIRECTIONAL SWITCH

(71) Applicant: Valeo Japan Co., Ltd., Saitama (JP)

(72) Inventor: Tsuyoshi Matsumoto, Tokyo (JP)

(73) Assignee: Valeo Japan Co., Ltd. (JP)

( * ) Notice: Subject to any disclaimer, the term of this patent is extended or adjusted under 35 U.S.C. 154(b) by 8 days.

(21) Appl. No.: 14/439,475

(22) PCT Filed: Oct. 28, 2013

(86) PCT No.: PCT/JP2013/079141

§ 371 (c)(1),
(2) Date: Apr. 29, 2015

(87) PCT Pub. No.: WO2014/069404

PCT Pub. Date: May 8, 2014

(65) Prior Publication Data

US 2015/0255234 A1 Sep. 10, 2015

(30) Foreign Application Priority Data

Oct. 31, 2012 (JP) ..... 2012-241318

(51) Int. Cl.
*H01H 9/00* (2006.01)
*H01H 25/00* (2006.01)
*H01H 25/04* (2006.01)

(52) U.S. Cl.
CPC ..... *H01H 25/008* (2013.01); *H01H 25/041* (2013.01); *H01H 2221/012* (2013.01); *H01H 2221/03* (2013.01)

(58) Field of Classification Search
CPC .. H01H 9/00; H01H 1/32; H01H 3/08; H01H 3/12; H01H 13/50; H01H 13/52; H01H 19/14; H01H 19/20; H01H 19/50; H01H 19/54; H01H 2221/008; H01H 2221/01; H01H 2221/012; H01H 2221/05; H01H 2221/054; H01H 2221/058; H01H 2221/06; H01H 2221/088; H01H 2221/03; H01H 19/00; H01H 19/64; H01H 19/56; H01H 21/00; H01H 25/06; H01H 25/065; H01H 25/008; H01H 25/041; H01H 23/02; G05G 9/04785; G05G 9/047; G05G 2009/04707
USPC ... 200/4, 520, 521, 529, 537, 538, 552, 553, 200/557, 329, 336, 339, 341, 6 A, 6 R
See application file for complete search history.

(56) References Cited

FOREIGN PATENT DOCUMENTS

JP 2000-322981 A 11/2000

*Primary Examiner* — Anthony R. Jimenez
(74) *Attorney, Agent, or Firm* — Fishman Stewart PLLC

(57) ABSTRACT

There is provided a multidirectional switch in which, when a knob in a neutral position is operated to be tilted with respect to a reference axis at the time the knob is in the neutral position, a pressing part positioned in an operating direction side of the knob moves in an axial direction of the reference axis to selectively close a switch element corresponding to the moved pressing part. The switch element and the pressing part respectively comprise four switch elements and four pressing parts that are respectively provided at intervals each having 90 degrees in the circumferential direction around the reference axis, and one pressing part is connected to another pressing part adjacent thereto in the circumferential direction around the reference axis by a flexible connecting element formed in a wave shape as viewed in a radial direction of the reference axis.

7 Claims, 9 Drawing Sheets

Ln1
Ln2
A
A
X
421
422
423
424
425
426
427
427a
428
428a
429
430
41
42
43

3
X
310
311
312
313
315
316
316a
31
32
321
322
323

5
51A
51B
51C
51D
510
510a
511
512
513
55
424
63
X
r
Im1
A
B
C
D
L
7

MULTIDIRECTIONAL SWITCH

BACKGROUND OF THE INVENTION

Field of the Invention

The present invention relates to a multidirectional switch that selectively closes a switch element by operating a knob to tilt in a predetermined direction.

Description of the Related Art

Japanese Patent Laid-Open Publication No. 2000-322981 discloses a multidirectional switch that selectively closes a switch element in a housing by operating a knob to tilt in a predetermined direction.

FIGS. 9A, 9B, 9C illustrate a primary part of a conventional multidirectional switch, wherein FIG. 9A is an exploded perspective view thereof.

The multidirectional switch is provided with movable contacts 102 that are respectively attached to support parts 101 of an elastic support member 100. When the support part 101 is pressed and moved by a bar-like operating member 103 that advances/retreats in cooperation with an operation of a knob, the movable contact 102 supported to the support part 101 makes contact with/is separated from a fixed contact 105 that is provided on a surface of a print substrate 104.

In the print substrate 104, the fixed contact 105 comprises a plurality of fixed contacts that are provided at regular intervals in a circumferential direction around a reference axis X of the knob, and are arranged in a ring shape as viewed in an axial direction of the reference axis X.

The movable contacts 102 and the operating members 103 respectively are also provided at regular intervals in the circumferential direction around the reference axis X of the knob, and arranged in a ring shape as viewed in the axial direction of the reference axis X.

Therefore when the knob is operated to tilt in a predetermined direction to cause the operating member 103 positioned in the operating direction of the knob to move in the axial direction of the reference axis X, the movable contact 102 of the support member 101 pressed by the moved operating member 103 makes contact with the fixed contact 105 (see FIG. 9B).

Here, in a case where the respective operating members 103 are provided independently from each other, since assembling performance of the multidirectional switch is deteriorated, each of the operating members 103 is connected to the two, other operating members 103 adjacent thereto in the circumferential direction of the reference axis X through thin plate-shaped connecting elements 106 and 107.

However, in a case where the operating members 103 adjacent with each other in the circumferential direction of the reference axis X are simply connected, when one operating member 103 moves in the axial direction of the reference axis X, there are some cases where another operating member 103 adjacent to the moved operating member 103 is pulled, therefore moving in the same direction with the moved operating member 103.

In this case, in addition to the movable contact 102 that should be originally contacted, there are some cases where the other movable contact 102 adjacent to this movable contact 102 also makes contact with the corresponding fixed contact 105. To avoid this problem, in a case of Japanese Patent Laid-Open Publication No. 2000-322981, one connecting element 107 of the connecting elements 106 and 107 is made longer. Therefore when one operating member 103 moves, another operating member 103 adjacent thereto does not move following this moved operating member 103.

Here, since a radial size of the multidirectional switch is limited, the connecting element 107 is diverted at the reference axis X side for ensuring the length, and the adjacent operating members 103 are connected to each other. Therefore the connecting element 107 is formed in a substantially V-letter shape as axially viewed, and a sharp bent part 107*a* of the connecting element 107 is positioned in the vicinity to the reference axis X.

Here, when the multidirectional switch is designed such that a recessed click groove is disposed in the center of a polar board (not illustrated) that supports the print substrate, and a click pin extending from the knob is engaged to the click groove on the reference axis to create the click feeling in the tilting operation of the knob, a click groove 108 results in being arranged in a position shown in a virtual line in FIG. 9C, for example.

With this arrangement of the click groove 108, the bent part 107*a* of the connecting element 107 projecting toward the reference axis X interferes with the click groove 108.

In this case, for avoiding interference with the click groove 108, it is considered to shorten the connecting element 107 for suppressing the projecting amount thereof to the reference axis X side. However, when one operating member 103 is operated to move in a state where the connecting element 107 is made short, it is not possible to prevent another operating member 103 adjacent thereto from moving following the movement of the one operating member 103. Therefore there is a possibility that the movable contact 102 that is not expected to be contacted makes contact with the corresponding fixed contact 105.

In addition, it is considered to extend the connecting element 107 outward in the radial direction, but in this case, the multidirectional switch is radially increased in size.

Therefore, it is required to provide a multidirectional switch that is provided with a click mechanism on a reference axis of a knob while preventing a switch element from closing in error and preventing the multidirectional switch from radially increasing in size.

SUMMARY OF THE INVENTION

The present invention is made in view of the aforementioned problems, and an object of the present invention is to provide a multidirectional switch that is provided with a click mechanism on the reference axis of a knob without closing in error of the switch element and radially increasing a size of the multidirectional switch.

According to the present invention, there is provided a multidirectional switch in which, when a knob in a neutral position is operated to be tilted with respect to a reference axis at the time the knob is in the neutral position, a pressing part positioned at an operating direction side of the knob moves in an axial direction of the reference axis to selectively close a switch element corresponding to the pressing part, characterized in that:

the switch element and the pressing part respectively comprise the same number of the switch elements and the pressing parts that are respectively provided at predetermined intervals in the circumferential direction around the reference axis; and the pressing parts adjacent to each other in the circumferential direction around the reference axis are connected with each other by a flexible connecting element formed in a wave shape as viewed in a radial direction of the reference axis.

According to the present invention, since the connecting element that connects the operating parts adjacent to each other in the circumferential direction around the reference axis is formed in the wave shape as viewed in the radial direction of the reference axis, when the operating part positioned in the tilting direction of the operating knob moves in the axial direction of the reference axis, the connecting element extends, thus preventing the other operating part adjacent to the moved operating part from moving following the moved operating part. This configuration can prevent the switch element from closing in error.

In addition, since the connecting element is formed in such a shape as to wave in the axial direction of the reference axis, even if the length of the connecting element is made long, it is not necessary to dispose a space, which accommodates the connecting element, at the reference axis side. Therefore it is possible to ensure a space for providing a click mechanism at the reference axis side.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DESCRIPTION OF THE PREFERRED EMBODIMENT

Figure 1B:
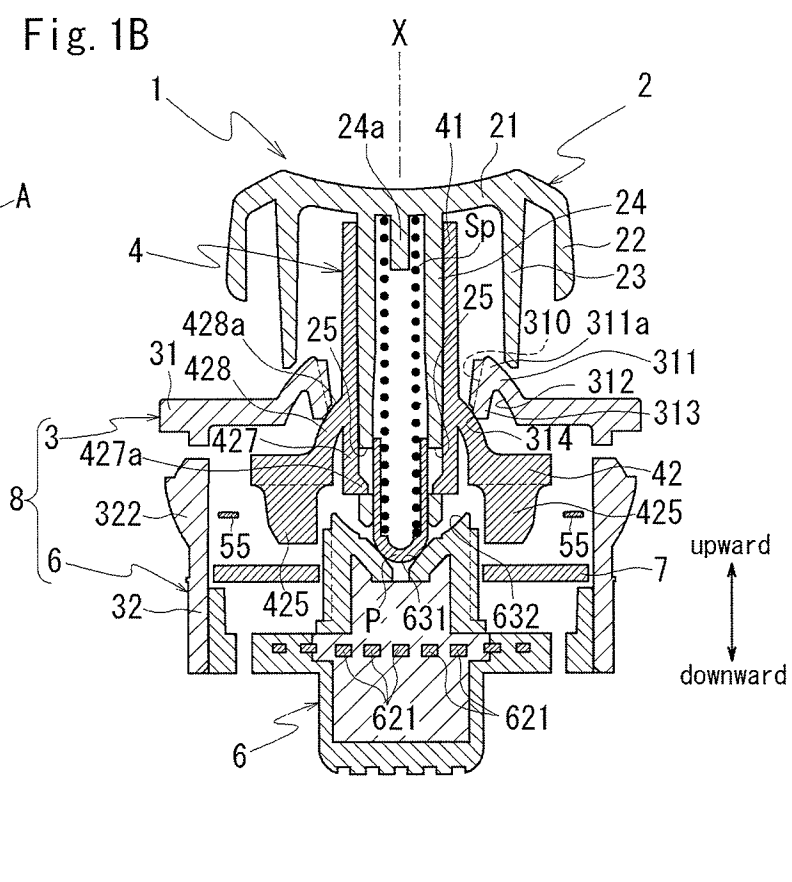
FIG. 1B is a sectional view illustrating the multidirectional switch, taken on a plane passing a reference axis X and vertical to plane A in FIG. 1A.
Figure 1A:
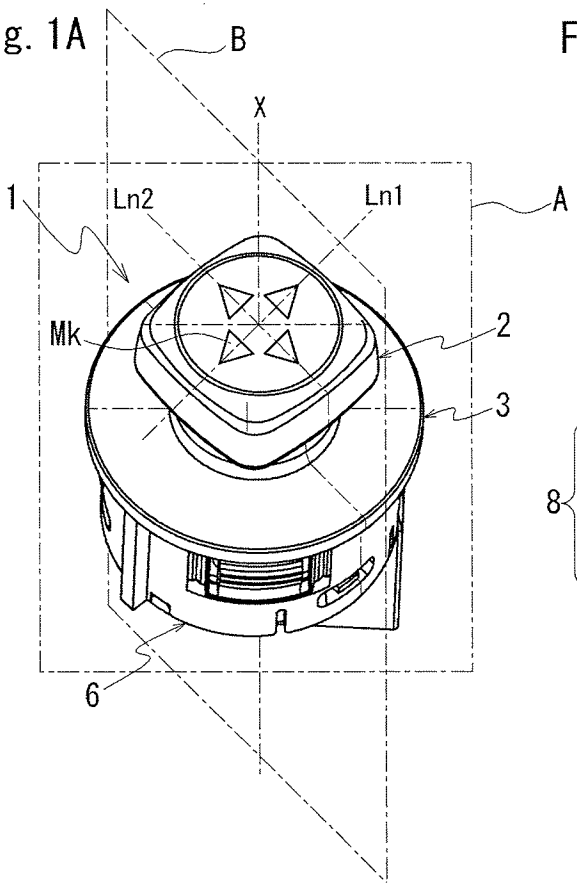
FIG. 1A is a perspective view illustrating a multidirectional switch according to an embodiment in the present invention.

Hereinafter, a multidirectional switch according to an embodiment of the present invention will be described with reference to the accompanying drawings. It should be noted that in the following explanation, a knob 2-side is described as "upward", and a polar board 6-side is described as "downward" in FIG. 1B for the descriptive purpose.

As illustrated in FIG. 1A and FIG. 1B to FIG. 3, a multidirectional switch 1 according to the embodiment includes a knob 2, a case 3, a movable board 4, an operating member 5, and polar board 6. The case 3 and the polar board 6 having a substrate 7 on an opposing surface to the case 3 are incorporated in an axial direction of a reference axis X (neutral axis) of the knob 2 to form a body case 8.

Tactile switches A to D are arranged on an upper surface of the substrate 7 at intervals each having 90 degrees in the circumferential direction around the reference axis X, and pressing parts 51A to 51D of the operating member 5 are respectively placed on the tactile switches A to D.

The multidirectional switch 1 is configured such that when the knob 2 in a neutral position is operated to tilt with respect to the reference axis X, the movable board 4 connected to the knob 2 presses down one of the pressing parts 51A to 51D positioned in the operating direction of the knob 2 to selectively close the corresponding tactile switch of the tactile switches A to D.

Hereinafter, an explanation will be made of each of components in the multidirectional switch 1.

[Knob 2]

As illustrated in FIGS. 1A, 1B and FIGS. 2A, 2B, the knob 2 includes a head part 21 on an upper surface of which marks Mk indicating operating directions of the knob 2 are attached, a peripheral wall part 22 that surrounds an outer periphery of the head part 21 over the entire periphery, a cylindrical wall part 23 that extends downward closer to the polar board 6 than the peripheral wall part 22 from the head part 21 at an inner diameter side of the peripheral wall part 22, and an axis part 24 in a cylindrical shape that extends toward the polar board 6 along the reference axis X from the central part of the head part 21.

An engagement part 24*a* in a columnar shape extends downward from the head part 21 in the axis part 24, and one end of a spring Sp is inserted in the axis part 24 to surround an outer periphery of the engagement part 24*a*.

A pin P having a U-letter shape in section is attached to the other end of the spring Sp to surround a part of the outer periphery of the spring Sp. The pin P projects from the lower end of the axis part 24, and a semispherical tip end part of the pin P abuts on an abutting part 631 of the polar board 6 to be described later.

Engagement holes 25 are provided at the lower side of the axis part 24 to radially penetrate through the axis part 24. The engagement holes 25 are provided at intervals each having 180 degrees in the circumferential direction around the reference axis X, and claws 427*a* of an engagement part 427 in the movable board 4 are radially engaged to the engagement holes 25 upon attaching the knob 2 to the movable board 4 to connect the knob 2 and the movable board 4.

[Movable 4]

As illustrated in FIG. 1B, the movable board 4 is provided with a connecting part 41 in a cylindrical shape, and an operating part 42 that radially extends from a lower part of the connecting part 41 positioned at the polar board 6-side.

As illustrated in FIGS. 4A to 4D, the operating part 42 has a basic shape of a quadrate as viewed in the axial direction, and is provided with chamfer parts 421 in four corners thereof. Guide elements 423 extending outward in the radial direction are provided respectively in side edge parts 422 of the operating part 42 that are disposed to oppose with each other centered around the reference axis X.

The guide element 423 has a substantially rectangular shape as viewed in the axial direction, and extends in an equal width from the central part of the side edge part 422 in the longitudinal direction.

The guide elements 423 are positioned in the preset tilting directions of the knob 2, and in the embodiment, are positioned on line segments Ln1 and Ln2 that pass the reference axis X and are perpendicular to each other.

Further, these guide elements 423 are inserted between guide walls 316*a* of guide parts 316 (refer to FIG. 5B) to be described later upon attaching the movable board 4 in the case 3 to block rotation of the movable board 4 around the reference axis X, and the tilting movement of the movable board 4 with respect to the reference axis X is guided with the upward and downward movement of the guide element 423 between the guide elements 316*a*.

Projecting parts 424 each having a semicircular shape in a sectional view are provided at an inner diameter side of the guide element 423 on a lower surface of the operating part 42 at the polar board 6-side to project downward toward the polar board 6.

The projecting parts 424 is equal in number to the tactile switches A to D, and in the embodiment, and comprise four projecting parts that are provided at intervals each having 90 degrees in the circumferential direction around the reference axis X.

The projecting parts 424 are likewise positioned in the tilting directions of the knob 2, and in the embodiment, are positioned on line segments Ln1, Ln2 that pass the reference axis X and are perpendicular to each other.

Further, the projecting part 424 is configured to respectively make contact with the pressing parts 51A to 51D of the operating member 5 to be described later in the axial direction of the reference axis X upon attaching the movable board 4 to the case 3.

In addition, when the movable board 4 is tilted in association with the operation of the knob 2, the projecting part 424 positioned in the tilting direction presses the corresponding pressing part of the pressing parts 51A to 51D in the operating member 5 downward toward the polar board 6.

The restriction part 425 that guides the tilting direction of the knob 2 in a predetermined direction is provided between the projecting parts 424 in the circumferential direction of the reference axis X to project downward toward the polar board 6. The restriction parts 425 comprise four restriction parts that are provided at intervals each having 90 degrees in the circumferential direction of the reference axis X. The restriction part 425 is provided to restrict the tilting of the knob 2 in a direction where the restriction part 425 is provided and guide the knob 2 in the predetermined tilting direction (directions of line segments Ln1 and Ln2).

It should be noted that the operation of the restriction part 425 will be in detail described later.

Slits 426 axially extending along the reference axis X are formed on an upper end of the connecting part 41. The slits 426 comprise three slits that are provided at intervals each having 90 degrees in the circumferential direction around the reference axis X, and the guide element 423 is positioned outward in the radial direction of the slit 426 as viewed in the axial direction of the reference axis X.

A reinforcing rib 210 (refer to FIG. 2A) of the knob 2 is inserted in the slit 426 upon the connecting the movable board 4 and the knob 2, so that a relative rotation of the movable board 4 and the knob 2 around the reference axis X is blocked by the reinforcing rib 210 engaged to the slit 426.

Figures 4A, 4B, 4C, 4D:
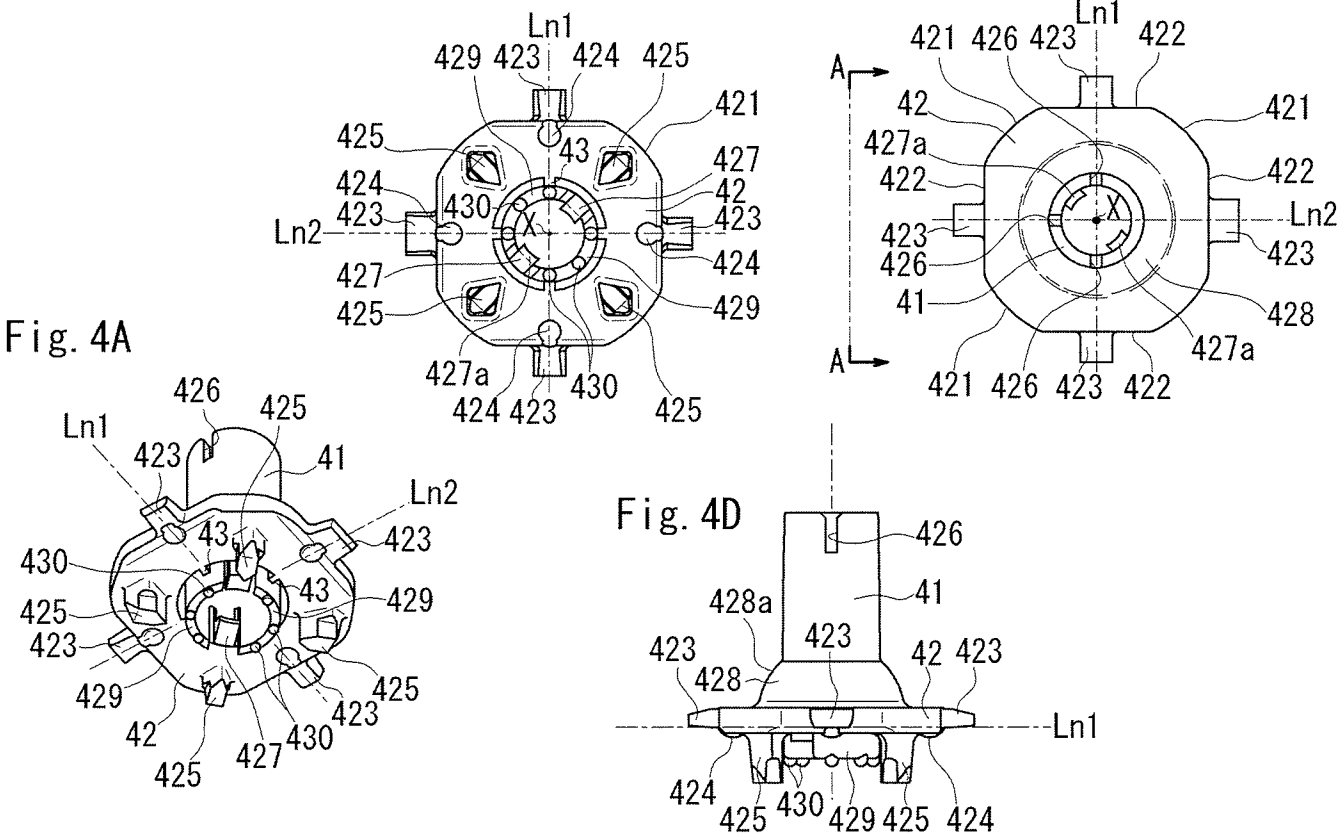
FIG. 4A is a perspective view illustrating a movable board as viewed from the downward at a polar board side according to the embodiment.
FIG. 4B is a plan view illustrating a movable board as viewed from the downward at a polar board side according to the embodiment.
FIG. 4C is a plan view illustrating a movable board as viewed from the upward at a knob side according to the embodiment.
FIG. 4D is a side view illustrating a movable board as viewed in the direction of arrows A-A in FIG. 4C.

As illustrated in FIGS. 4A, 4B, the engagement parts 427 extending downward toward the polar board 6 are connected to the lower end of the connecting part 41. The engagement parts 427 comprise two engagement parts that are provided at an interval of 180 degrees in the circumferential direction around the reference axis X, and the claw 427*a* projecting toward the reference axis X is formed on a tip end part of the engagement part 427.

As illustrated in FIG. 1B, the claw 427*a* of the engagement part 427 is engaged to the engagement hole 25 provided in the axis part 24 of the knob 2 upon connecting the movable board 4 and the knob 2 to block falling-down of the knob 2 from the movable board 4.

Arc-shaped wall parts 429 formed in an arc shape as viewed in the axial direction are provided between the engagement parts 427 in the lower part of the connecting part 41.

Spherical abutting parts 430 in a sectional view are provided on a lower end of each of the arc-shaped wall part 429, and comprise three spherical abutting parts that provided at equal intervals in the circumferential direction around the reference axis X.

Figure 2B:
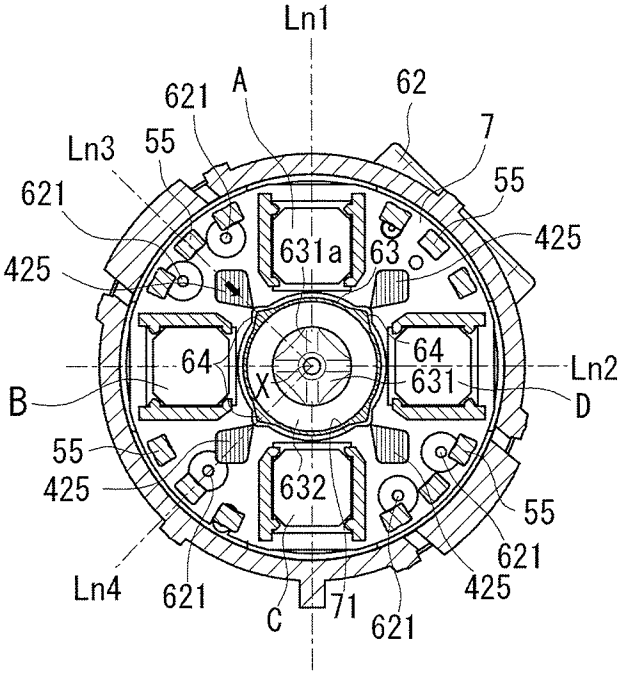
FIG. 2B is a sectional view taken along the direction of arrows A-A in FIG. 2A, omitting illustration of members (spring and pin) positioned inside of a cylindrical part of a polar board.
Figure 2A:
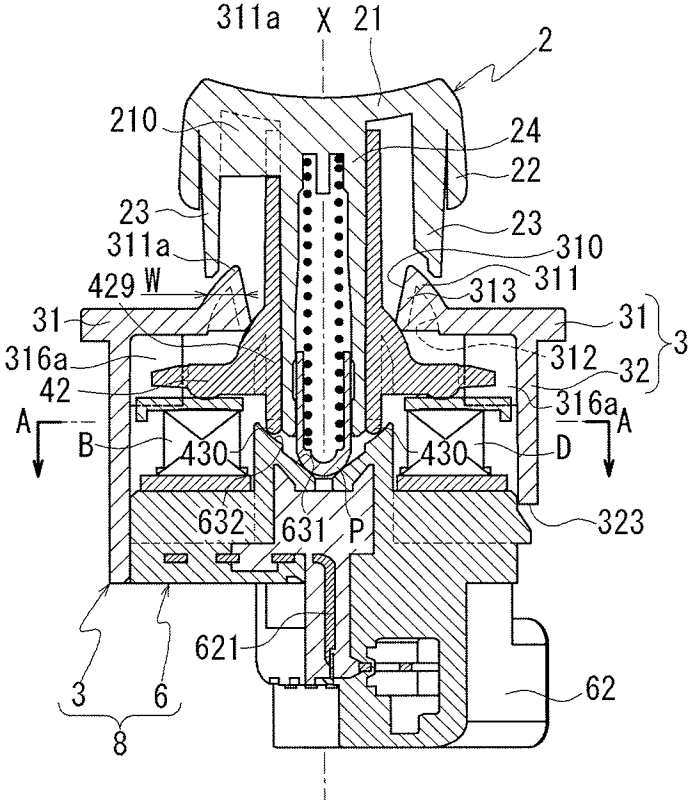
FIG. 2A is a sectional view illustrating the multidirectional switch, taken on a plane B in FIG. 1A.

The abutting parts 430 are configured to abut on a sliding part 632 provided on the polar board 6 in the axial direction of the reference axis X upon incorporating the movable board 4 in the body case 8 (refer to FIG. 2A).

As illustrated in FIG. 1B and FIG. 4D, a diameter enlarging part 428 gradually enlarging in diameter downward toward the polar board 6 is provided in the connecting part 41 at the operating part 42-side, and the connecting part 41 is connected to the operating part 42 through the diameter enlarging part 428.

In a sectional view, the diameter enlarging part 428 has an outer peripheral surface 428*a* that is formed in a curved shape, and in the multidirectional switch 1, the movable board 4 is provided in a state where the outer peripheral surface 428*a* of the diameter enlarging part 428 abuts on a contact part 314 of the case 3.

In addition, the contact part 314 of the case 4 slides on the outer peripheral surface 428*a* at the time the movable board 4 tilts in association with the operation of the knob 2 (refer to FIG. 1B).

[Case 3]

The case 3 has a basic shape that is formed in a bottomed cylindrical shape, and is provided with a ring-shaped wall part 31 forming an upper wall part of the body case 8, and a cylindrical peripheral wall part 32 extending downward toward the polar board 6 from an outer peripheral side of the wall part 31.

A through hole 310 is provided in the central part of the wall part 31 to penetrate the wall part 31 in the thickness direction, and a boss part 311 surrounding the through hole 310 over the entire periphery is formed on an upper surface of the wall part 31 to project upward toward the knob 2.

As illustrated in FIG. 1B and FIG. 2A, a radial width W of the boss part 311 in a sectional view is narrower toward the upward side, and an upper end 311*a* of the boss part 311 is positioned at an inner diameter side of the cylindrical wall part 23 of the knob 2 to prevent foreign objects such as dust from entering the through hole 310-side.

A recessed groove 312 surrounding the through hole 310 is formed on a lower surface of the boss part 311, and an inner diameter side of the recessed groove 312 is formed as an abutting part 313 on the aforementioned diameter enlarging part 428 of the movable board 4.

The contact part 314 with the diameter enlarging part 428 of the movable board 4 is provided in a lower part of the abutting part 313 at the inner diameter side, and an opposing surface of the contact part 314 to the diameter enlarging part 428 is formed in an arc shape to align with an outer diameter of the diameter enlarging part 428.

In the embodiment, the abutting pat 313 is in a state of being cantilever-supported with the wall part 31 by the recessed groove 312 provided on the wall part 31, and a lower side of the abutting part 313 on which the contact part 314 is provided is radially movable. Therefore the diameter enlarging part 428 of the movable board 4 is flexibly supported by the abutting part 313 to prevent the tilting movement of the movable board 4 in association with the operation of knob 2 from being blocked.

Figures 5A, 5B, 5C, 5D:
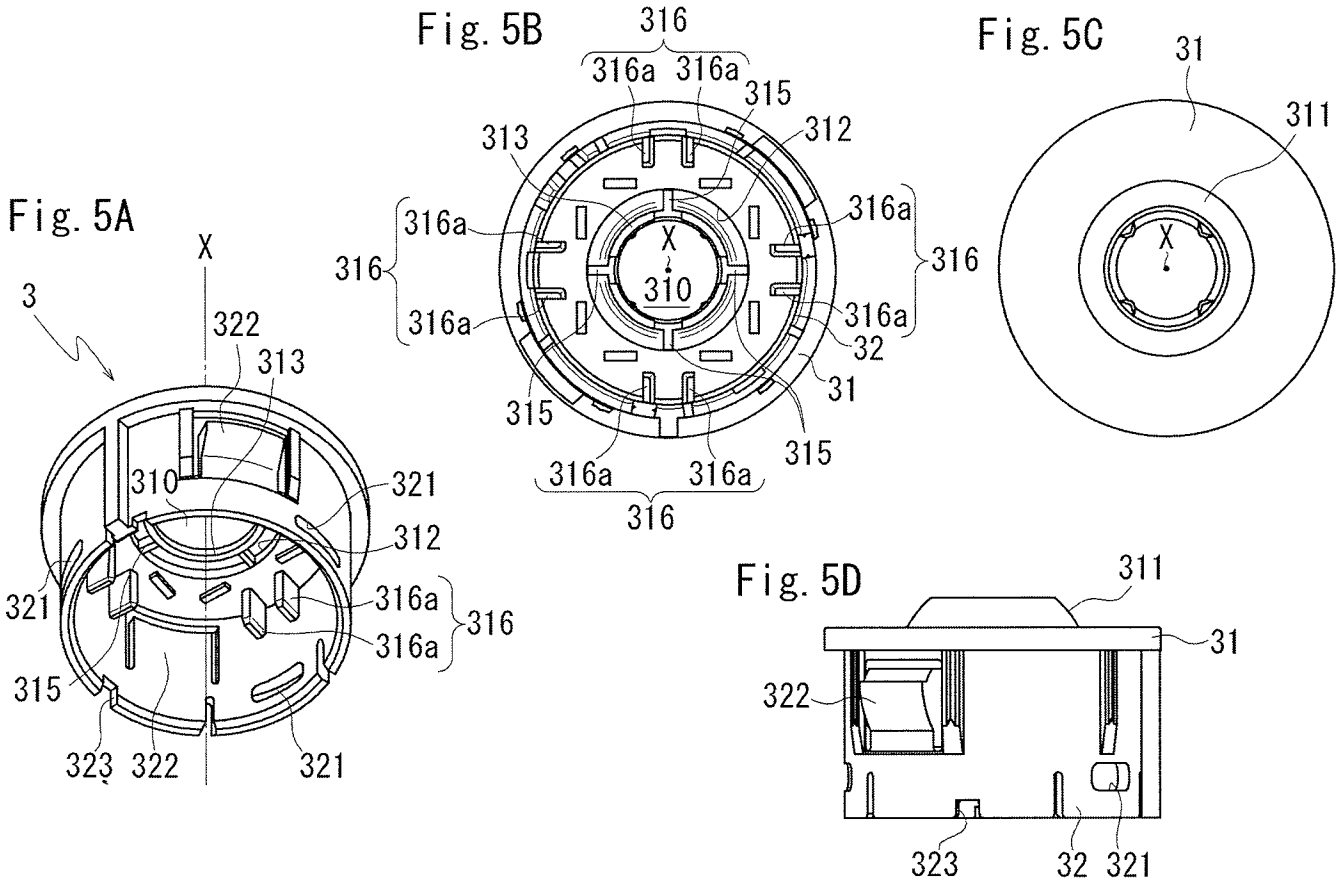
FIG. 5A is a perspective view illustrating a case as viewed from the downward at a polar board side according to the embodiment.
FIG. 5B is a plan view illustrating a case as viewed from the downward at a polar board side according to the embodiment.
FIG. 5C is a plan view illustrating a case as viewed from the upward at a knob side according to the embodiment.
FIG. 5D is a side view illustrating a case according to the embodiment.

It should be noted that, as illustrated in FIG. 5B, ribs 315 extending in the tilting direction of the knob 2 are connected to the abutting part 313, and the rib 315 prevents a displacement amount of the abutting part 313 to the contact part 314-side from being excessively large.

As illustrated in FIG. 1B and FIG. 2A, the peripheral wall part 32 extends downward toward the polar board 6 from a position offset in the inner diameter side from the outer periphery of the wall part 31, and engagement holes 321 and notches 323 penetrating the peripheral wall part 32 in the thickness direction are, as illustrated in FIG. 5A, provided in the downward side of the peripheral wall part 32.

The engagement holes 321 comprise three engagement holes that are provided at intervals in the circumferential direction around the reference axis X, and, at the time of attaching the case 3 to the polar board 6, engagement claws 611 (refer to FIG. 3) of the polar board 6 are engaged respectively to the engagement holes 321 to block the falling-down of the case 3 from the polar board 6.

In addition, the notches 323 comprise two notches that are provided at an interval in the circumferential direction around the reference axis X, and each of engagement projections 612 (refer to FIG. 3) of the polar board 6 is engaged to each of the notches 323 at the time of attaching the case 3 to the polar board 6 to prevent the case 3 from rotating relative to the polar board 6.

As illustrated in FIG. 5B, the guide parts 316 comprise four guide parts that are provided at intervals each having 90 degrees in the circumferential direction around the reference axis X on a lower surface of the wall part 31 at the polar board 6-side, and support the guide elements 423 of the movable board 4 mentioned above.

Each of the guide parts 316 comprises a pair of guide walls 316*a*, which extend downward toward the polar board 6 along the inner periphery of the peripheral wall part 32.

The guide walls 316*a* are formed as long as to reach the vicinity of the tactile switches A to D of the polar board 6 (refer to FIG. 2A), and the guide element 423 of the movable board 4 is configured to be inserted between the guide walls 316*a*.

In the embodiment, the guide part 316 is provided to guide the movement (tilting) of movable board 4, which tilts in association with the operation of the knob 2, in the axial direction of the reference axis X, and restrict rotation of the movable board 4 in the circumferential direction around the reference axis X.

The peripheral wall part 32 is provided with engagement claws 322 in positions symmetric with respect to the reference axis X to fix the multidirectional switch 1 to a counterpart member. The engagement claws 322 comprise two fixing projections that are provided at an interval of 180 degrees in the circumferential direction around the reference axis X, and the engagement claw 322 is positioned between the guide parts 316 adjacent thereto in the circumferential direction as viewed in the axial direction of the reference axis X.

Each of the engagement claws 322 has a downward part at the polar board 6-side that is cantilever-supported by the peripheral wall part 32 and an upward part at the wall part 31-side that is flexibly deformable in the radial direction of the reference axis X.

[Polar Board 6]

Figure 3:
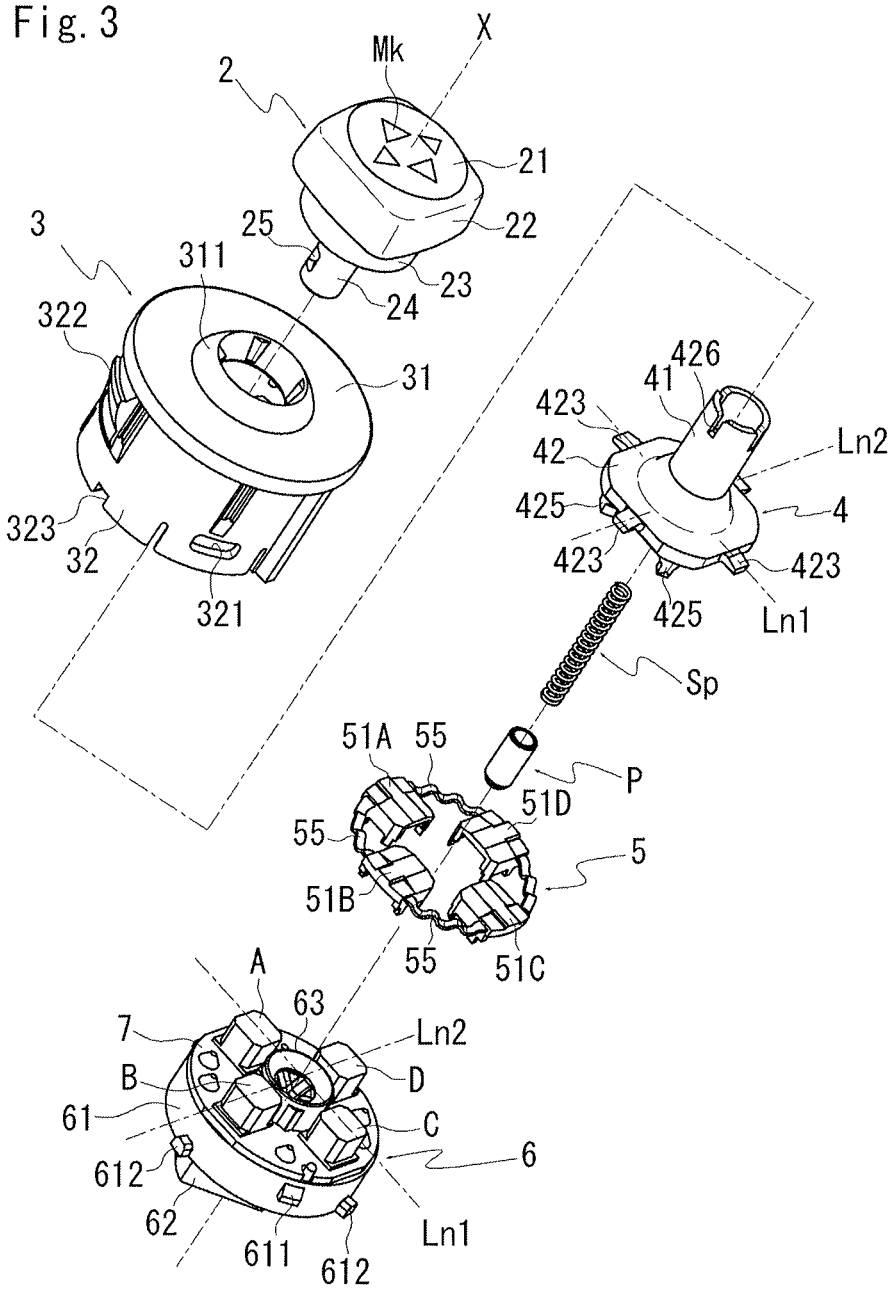
FIG. 3 is an exploded perspective view illustrating the multidirectional switch according to the embodiment.

As illustrated in FIG. 3, the polar board 6 has a base part 61, on which the substrate 7 is attached, on an opposing surface to the case 3, and a connector part 62 is provided in a lower part of the base part 61 to open in the radial direction of the reference axis X.

As illustrated in FIGS. 1A, 1B and FIGS. 2A, 2B, connecting terminals 621 extending from the connector part 62 are embedded in the polar board 6 by insert-molding, and a tip end part of the connecting terminal 621 extends in the axial direction of the reference axis X, and then, is soldered to an upper surface of the substrate 7 (refer to FIG. 2B).

The tactile switches A to D are attached on the upper surface of the substrate 7 at the case 3-side. Each of the tactile switches A to ID is a switch element of a push type, and when each of the tactile switch A to D is pressed in the axial direction of the reference axis X to move, the switch element is closed.

An opening 71 (refer to FIG. 2B) is provided in the center of the substrate 7 for insert of a cylindrical part 63 extending upward toward the case 3 from the polar board 6, and the tactile switches A to D are provided to surround the opening 71 (cylindrical part 63).

In the embodiment, the tactile switches A to D are provided at intervals each having 90 degrees in the circumferential direction of the reference axis X as viewed in the axial direction of the reference axis X.

The inside of the cylindrical part 63 is recessed in a mortar shape, a central part at the reference axis X-side is formed as an abutting part 631 of the pin P supported by the axis part 24 of the knob 2, and the periphery of the abutting part 631 is formed as a sliding part 632 of the abutting part 430 provided in the arc-shaped wall part 429 of the knob 2.

As viewed from the upward at the knob 2-side, the abutting part 631 is provided with a groove 631*a* formed in a cross shape in a plan view. When the knob 2 is operated to tilt, the pin P slides along the groove 631*a*, and thereby the tilting direction of the knob 2 is set to a direction along the groove 631*a*.

Therefore in the embodiment, any of the tactile switches A to D is positioned on the extension line of the groove 631*a*.

As illustrated in FIG. 2B, sharp projecting parts 64 are provided on the outer peripheral surface of the cylindrical part 63 as viewed in the axial direction of the reference axis X to project outward in the radial direction. The projecting parts 64 comprise four projecting parts at intervals each having 90 degrees in the circumferential direction of the reference axis X, and the projecting part 64 and the restriction part 425 are arranged to oppose to each other in the circumferential direction of the reference axis X.

In the embodiment, the knob 2 is tilted in any of the four directions along the axis lines Ln1, Ln2 to close any of the tactile switches A to D, and when the knob 2 is operated in a direction other than the four directions, the restriction part 425 of the movable board 4 abuts on the projecting part 64 of the cylindrical part 63 to restrict the movement of the knob 2 in that direction.

Figure 6B:
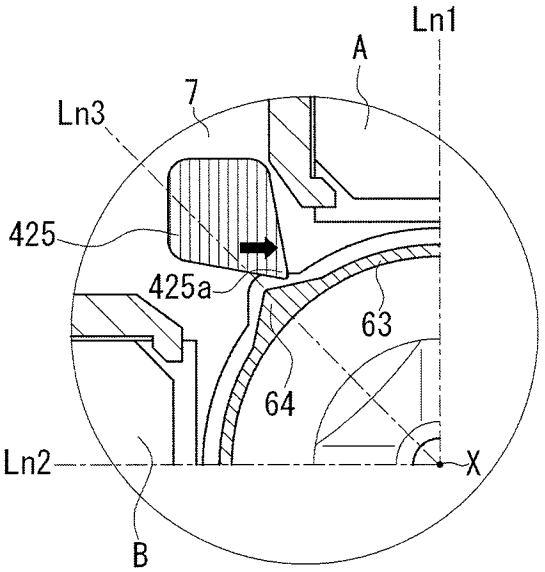
FIGS. 6A and 6B are diagrams each explaining an operation of a restriction part according to the embodiment.
Figure 6A:
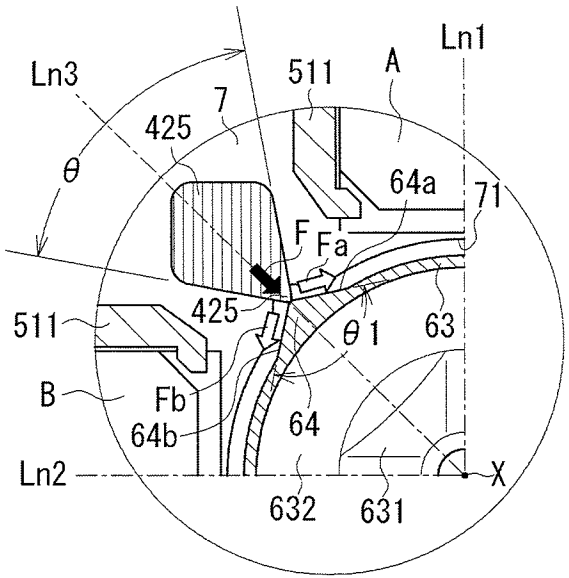

FIG. 6A is a diagram explaining a case where the knob 2 is tilted in a direction other than a preset tilting direction (direction of line segment Ln3) and FIG. 6B is a diagram explaining a case where the knob 2 is tilted in a preset tilting direction (direction of line segment Ln2 and of closing the tactile switch B).

An explanation will be made of the operation of the restriction part 425 by taking a case where the knob 2 is tilted to the left, oblique and upward side in FIG. 2B, and the restriction part 425 of the movable board 4 positioned in the left, oblique and upward side moves to the right, oblique and downward side shown in black arrow in the figure, as an example.

In this case, the projecting part 64 projecting from the cylindrical part 63 of the polar board 6 is positioned in the right, oblique and downward of the restriction part 425. Therefore, as illustrated in FIG. 6A, the restriction part 425 that has moved in a direction of black arrow F in the figure abuts on the projecting part 64 by the sharp tip end part 425*a*, so that the further movement thereof to the right, oblique and downward side is blocked. Therefore the operation of the knob 2 in a direction of causing the restriction part 425 to move to the right, oblique and downward side is also blocked.

Here, an angle θ of the tip end part 425*a* of the restriction part 425 is sharper than an angle θ1 in the tip end side of the projecting part 64. Therefore when the knob 2 is further operated to press the restriction part 425 to the black arrow F-side, the tip end part 425*a* moves along any of inclined surfaces 64*a*, 64*b* of the projecting part 64. As a result, the restriction part 425 moves in a direction of any of arrows Fa, Fb in the figure, that is, in a direction of moving the knob 2 in a preset direction (direction of line segment Ln1 or Ln2).

In the embodiment, when the knob 2 is thus operated in the upper and lower direction and the right and left direction in the figure, any of the tactile switches A to D positioned in the operating direction side closes. Therefore when the knob 2 is operated in a direction other than the preset directions (upper, lower, right and left directions in the figure), the restriction part 425 abuts on the projecting part 64. Therefore the operation of the knob 2 in that direction is blocked, and thereafter, the knob 2 is guided in the preset direction by the inclined surface 64*a* or 64*b* of the projecting part 64.

As illustrated in FIG. 3, each of the pressing parts 51 (51A to 51D) of the operating member 5 is placed on an upper surface of each of the tactile switches A to D at the case 3-side.

[Operating Member 5]

Hereinafter, the operating member 5 will be explained.

Each of the pressing parts 51 of the operating member 5 is provided to transmit an urging force from each of the projecting part 424 of the movable board 4 equally to the surface of each of the tactile switches A to D.

The operating member 5 is provided with placement parts 510 each placed on the upper surface of each of the tactile switches A to D, side wall parts 511 extending downward toward the substrate 7 from both sides of the placement part 510 in the circumferential direction of the reference axis X, and leg parts 512 projecting toward the substrate 7 from the lower end of the side wall part 511 at the substrate 7-side. These parts are integrally formed of flexible materials.

Here, as described above, the projecting part 424 of the movable board 4 projects from the lower surface of the operating part 42 at the polar board 6-side. Therefore in a case where the urging force (operating force) that is input from the operating part 42 is designed to be input to the corresponding tactile switch of the tactile switches A to D directly from the projecting part 424 without having the operating member 5, the projecting part 424 makes point contact with the corresponding tactile switch of the tactile switches A to D. Therefore there is a possibility that the input urging force focuses on one point of the corresponding tactile switch of the tactile switches A to D to damage the corresponding tactile switch of the tactile switches A to D.

In the embodiment, the operating member 5 (pressing parts 51) made of the flexible material is interposed between the projecting parts 424 and the tactile switches A to D, and thereby the input urging force is transmitted equally onto the upper surface of each of the tactile switches A to D, thus preventing the damage of each of the tactile switches A to D.

The placement part 510 is formed in a substantially rectangular shape in a plan view, and projections 513 are provided on the respective opposing surfaces of the side wall parts 511 extending downward toward the polar board 6 from the placement part 510. The projections 513 on the side wall part 511 are provided at an interval in the longitudinal direction of the side wall part 511. In a plan view, the projections 513 of one side wall part 511 and the projections 513 of the other side wall part 511 are arranged to hold four corners of a rectangular shape of each of the tactile switches A to D.

The pressing parts 51 (51A to 51D) are provided at intervals each having 90 degrees in the circumferential direction of the reference axis X, and the pressing parts 51 adjacent to each other in the circumferential direction are connected to each other by the flexible connecting elements 55 formed in a wave shape as viewed in the radial direction of the reference axis X.

Figures 7A, 7B, 7C, 7D, 7E:
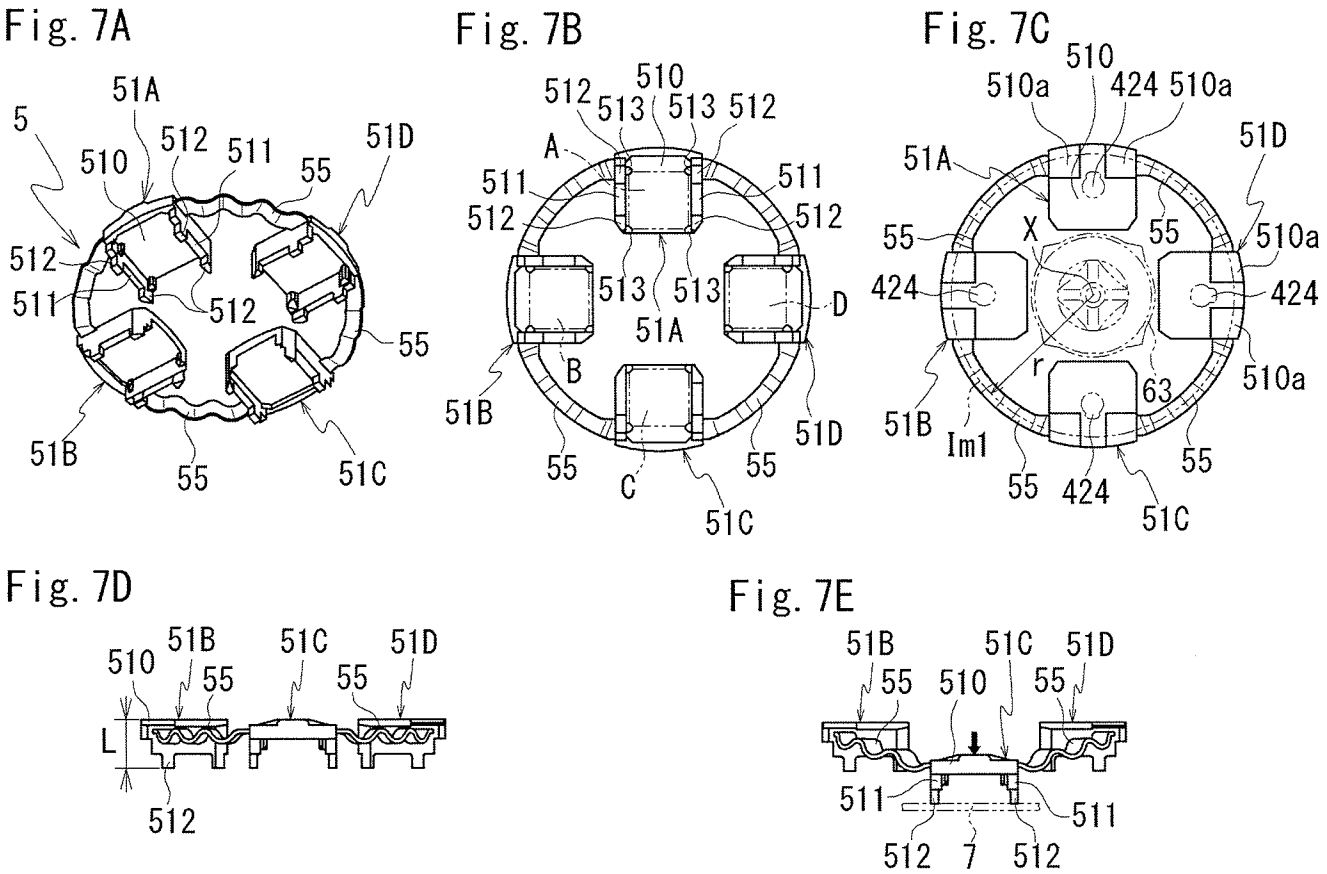
FIG. 7A is a perspective view illustrating an operating member as viewed from the downward at a polar board side according to the embodiment.
FIG. 7B is a plan view illustrating an operating member as viewed from the downward at a polar board side according to the embodiment.
FIG. 7C is a plan view illustrating an operating member as viewed from the upward at a knob side according to the embodiment.
FIG. 7D is a side view illustrating an operating member according to the embodiment.
FIG. 7E is a diagram explaining a state of an operating member when a pressing part is moved downward toward a substrate according to the embodiment.

The connecting element 55 is formed in an arc shape as viewed in the axial direction of the reference axis X, and has a shape along a virtual circle Im1 of a predetermined radius r centered around the reference axis X (refer to FIG. 7C).

The pressing parts 51 (51A to 51D) are provided to project closer to the inner diameter side than the virtual circle Im1, and a space is ensured at the inner diameter side of the pressing part 51 to provide the cylindrical part 63 of the polar board 6.

Here, as illustrated in FIG. 7D, the connecting element 55 is formed in a wave shape in which peaks and troughs are alternately continuously formed in the circumferential direction of the reference axis X (in such a shape as to wave in the axial direction of the reference axis X), and the pressing parts 51 (51A to 51D) are independently movable in the axial direction of the reference axis X.

For example, when the pressing part 51C is pressed downward toward the substrate 7 (polar board 6) by the operation of the knob 2, as illustrated in FIG. 7D, the connecting elements 55 extending from the pressing part 51C each extend in the longitudinal direction while reducing an amplitude of the wave shape. Therefore the other pressing parts 51B, 51D adjacent to the pressing part 510 are configured in such a manner not to move downward toward the substrate 7 following the movement of the pressing part 51C.

It should be noted that since the leg parts 512 projecting downward toward the substrate 7 are provided in the side wall part 511 of the pressing part 51C, when the pressing part 51C moves toward the substrate 7 by the operation of the knob 2, the movement of the pressing part 51C is finished in a position where the leg parts 512 abut on the substrate 7.

In the embodiment, a length of the leg part 512 from the placement part 510 is set according to a stroke amount of any of the tactile switches A to D, which prevents any of the tactile switches A to D from being pressed down more than necessary to be damaged.

Specifically, the length L (refer to FIG. 7D) from the placement part 510 to a tip end part of the leg part 512 is set to the length to the extent that the leg part 512 abuts on the substrate 7 when the pressing part 51 (51A to 51D) presses any of the tactile switches A to D to the substrate 7-side to close the moved tactile switch of A to D.

In addition, as illustrated in 7C, recessed parts 510*a* are provided at both sides in the width direction on an upper surface of the placement part 510 at the movable board 4-side. The recessed part 510*a* is recessed closer to the downward toward the polar board 6-side than the abutting part Slob on which the projecting part 424 of the movable board 4 abuts, and is positioned on the virtual circle Im1 overlapping the connecting element 55 as viewed in the axial direction of the reference axis X.

For example, the recessed parts 510*a* of the pressing part 51A are provided to prevent the guide element 423 (refer to FIG. 4C) of the movable board 4 positioned at the pressing part 51A-side from interfering with the placement part 510 when the movable board 4 tilts in a direction of pressing down the pressing part 51B or pressing part 51D toward the polar board 6.

When the knob 2 is operated in a direction (right side in FIG. 8A) of closing the tactile switch D, the movable board 4 connected to the knob 2 tilts in a direction of moving the guide element 423 at the tactile switch D-side downward toward the polar board 6.

Then, the pin P urged by the spring Sp slides on the abutting part 631 of the polar board 6 to give the click feeling to the operation of the knob 2.

At this time, the operating part 42 tilts while moving the guide element 423 downward between the guide walls 316*a* provided in the case 3 and moves the pressing part 51D (placement part 510) of the operating member 5 and the tactile switch D on which the pressing part 51D is placed downward toward the polar board 6 by the projecting part 424 provided in the lower part of the operating part 42, thus closing the tactile switch D.

Here, the pressing part 51D is connected through the connecting elements 55 to the other pressing part 51C and pressing part 51A (not illustrated) adjacent to the pressing part 51D in the circumferential direction around the reference axis X. However, when the pressing part 51C moves downward toward the polar board 6, the connecting element 55 extending from the pressing part 51D extends in the longitudinal direction while reducing the amplitude of the wave shape, and as a result, the other pressing parts 51C, 51A adjacent to the pressing part 51D do not move downward toward the polar board 6 following the movement of the pressing part 51D.

It should be noted that since the tilting movement of the knob 2 is stopped in a position where the leg parts 512 extending downward from the pressing part 51D abut on the substrate 7, the tactile switch D is not pressed more than necessary to be damaged.

Figure 8B:
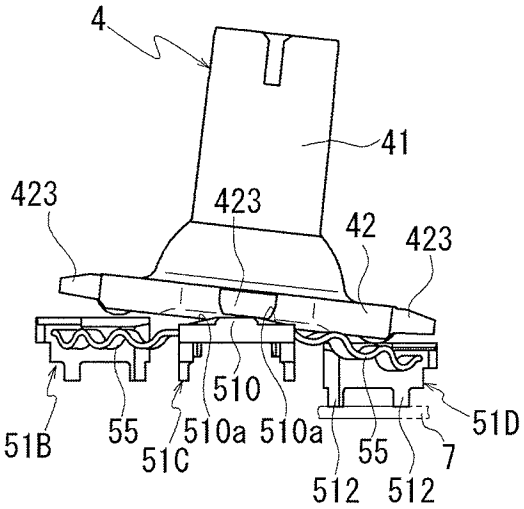
FIG. 8B is a diagram explaining a relation between a movable board and an operating member at the tilting of the movable member according to the embodiment.
Figure 8A:
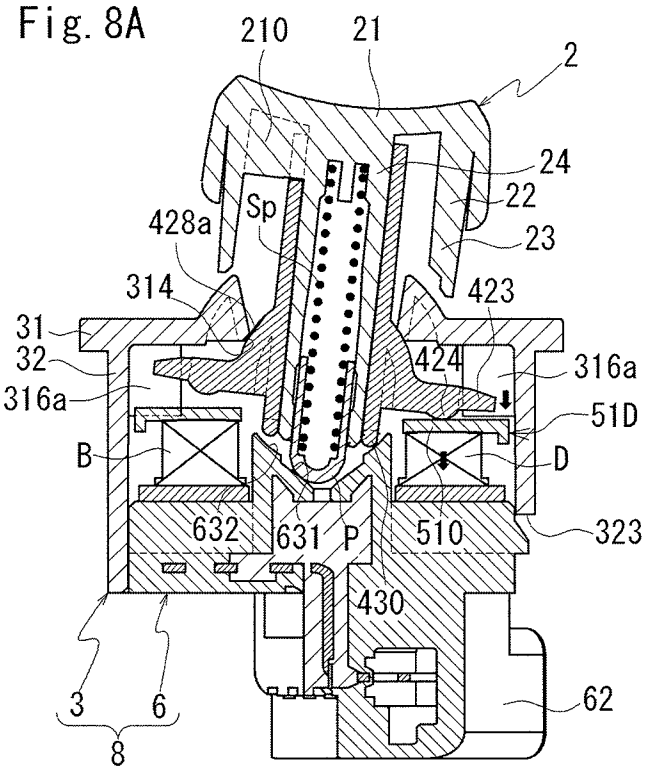
FIG. 8A is a sectional view illustrating a multidirectional switch at the time of tilting a knob in a direction of closing a tactile switch according to the embodiment.
Figure 9A:
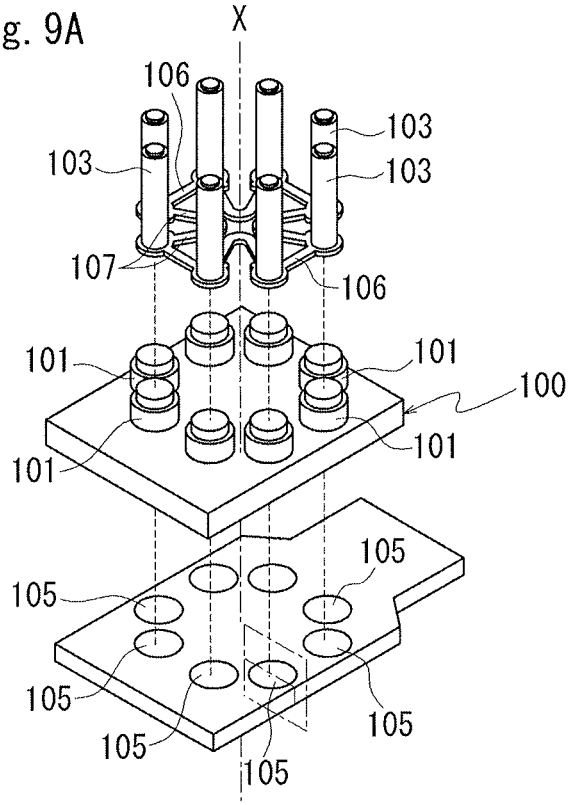
FIGS. 9A, 9B and 9C are diagrams explaining a multidirectional switch according to a conventional example.
Figure 9B:
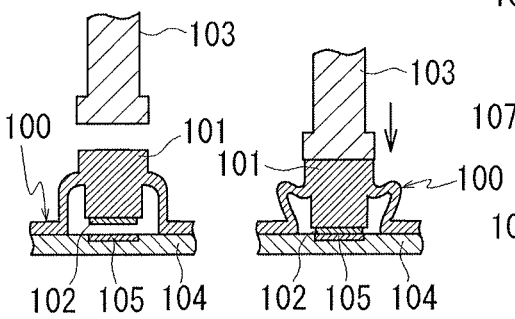
Figure 9C:
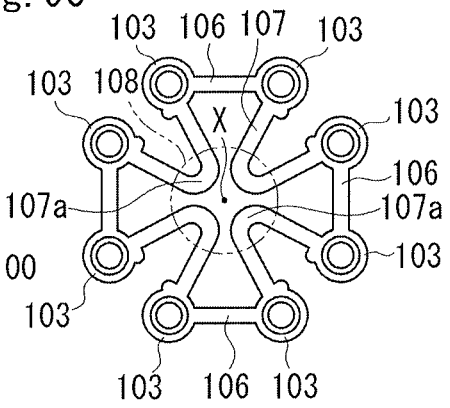

In addition, as illustrated in FIG. 8B, the pressing part 51C adjacent to the pressing part 51D is provided with the recessed parts 510*a* at both sides thereof in the width direction of the placement part 510. Therefore the guide element 423 at the pressing part 51C-side that is supposed to tilt following the tilting of the operating part 42 interferes with the pressing part 51C to prevent the tactile switch C positioned downward of the pressing part 51C from closing.

This configuration can prevent the other tactile switches A, C adjacent to the tactile switch D that should be originally closed from being closed.

As described above, according to the embodiment, there is provided the multidirectional switch 1 in which, when the knob 2 in the neutral position is operated to be tilted with respect to the reference axis X at the time the knob 2 is in the neutral position, the pressing part 51 (any of pressing parts 51A to 51D) positioned at the operating direction side of the knob 2 moves in the axial direction of the reference axis X to selectively close any of the tactile switches A to D (switch element) corresponding to the moved pressing part 51 (any of the pressing parts 51A to 51D), characterized in that the tactile switches A to D and the pressing parts 51 (51A to 51D) respectively comprise the four tactile switches and the four pressing parts that are respectively provided at intervals each having 90 degrees in the circumferential direction around the reference axis X, and the pressing part 51 (one of 51A to 51D) and the other pressing parts 51 (of 51A to 51D) adjacent thereto in the circumferential direction around the reference axis X are connected with each other by the flexible connecting elements 55 formed in the wave shape as viewed in the radial direction of the reference axis X.

According to the above configuration, for example, when the pressing part 51C is pressed downward toward the substrate 7 (polar board 6) by the operation of the knob 2, as illustrated in FIG. 7E, the connecting elements 55 extending from the pressing part 51C extend in the longitudinal direction while reducing the amplitude of the wave shape, thereby making it possible to prevent the other pressing parts 51B, 51D adjacent to the pressing part 51C from moving downward toward the substrate 7 following the pressing part 51C.

In addition, since the connecting element 55 has such a shape as to wave in the axial direction of the reference axis X, even if the length of the connecting element 55 is made long, it is not necessary to dispose the space, which accommodates the connecting element 55, at the inner diameter side of the connecting element 55 provided along the ring-shaped virtual circle Im1 as viewed in the axial direction, that is, at the reference axis X-side. Therefore it is possible to ensure the space for providing the click mechanism (cylindrical part 63) at the reference axis X-side.

Accordingly, for providing the click mechanism, in which the pin P urged by the spring Sp is made to abut on the abutting part 631 of the cylindrical part 63 provided in the center of the polar board 6 to create the click feeling at the time of operating the knob 2, in the central part of the multidirectional switch (on the reference axis X), it is not necessary to radially increase a size of the body case 8 in the multidirectional switch 1.

The multidirectional switch 1 has the operating part 42 positioned to be perpendicular to the reference axis X at the time the knob 2 is at the neutral position, and further has the movable board 4 (movable member) that is tilted by moving the operating direction side of the knob 2 in the operating part 42 to the polar board 6-side in the axial direction of the reference axis X when the knob 2 is operated, wherein the operating part 42 is provided with the projecting parts 424 (abutting parts) abutting on the pressing parts 51 (51A to 51D) in the preset directions (on line segments Ln1, Ln2) as the operating directions of the knob 2 as viewed in the reference axis X, and the restriction parts 425 (blocking parts) that block the tilting of the movable board 4 in the direction that is not preliminarily set as the operating direction of the knob 2, wherein when the knob 2 is operated in the direction that is not preliminarily set as the operating direction of the knob 2, the restriction part 425 abuts on the projecting part (fixed-side stopper) of the polar board 6 to block the operation of the knob 2 in the direction not preliminarily set. Further the inclined surfaces 64*a*, 64*b* are provided on the abutting surfaces of the projecting part 64 on the restriction part 425 to guide the tilting direction of the movable board 4 to the direction that is preliminarily set as the operating direction of the knob 2.

When the multidirectional switch 1 is configured in this manner, even if the knob 2 is operated in the direction that is not preliminarily set as the operating direction of the knob 2, since the operating direction of the knob 2 is guided in the direction that is preliminarily set as the operating direction of the knob 2, it is possible to close only any of the predetermined tactile switches A to D in the directions that are preliminarily set.

Each of the tactile switches A to D is the switch element that is closed at the time of being moved in a predetermined amount to the substrate 7-side by any of the pressing parts 51 (51A to 51D).

Each of the pressing parts 51 (51A to 51D) has the placement part 510 (contact part) placed on the upper surface of each of the tactile switches A to D at the opposite to the substrate 7 and the leg parts 512 extending toward the substrate 7 through the lateral sides of each of the tactile switches A to D from the side edges of the placement part 510.

The length L of the leg part 512 from the placement part 510 is made as long as to block the movement of any of the pressing parts 51 (51A to 51D) by abutment of the leg part 512 on the substrate 7 when any of the tactile switches A to D is pressed toward the substrate 7 to be moved in a predetermined amount.

With the above configuration, since the pushing-in of the tactile switch D is stopped in the position where the leg parts 512 extending downward from the pressing part 51D abut on the substrate 7. Therefore it is possible to prevent the tactile switch D from being pressed more than necessary to be damaged.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

DESCRIPTION OF REFERENCE SIGNS

1 Multidirectional switch
2 Knob
21 Head part
210 Reinforcing rib
22 Peripheral wall part
23 Cylindrical wall part
24 Axis part
24*a* Engagement part
25 Engagement hole
3 Case
31 Wall part
310 Through hole
311 Boss part
311*a* Upper end
312 Recessed part
313 Abutting part
314 Contact part
315 Rib
316 Guide part
316*a* Guide wall
32 Peripheral wall part
321 Engagement hole
322 Engagement claw
323 Notch
4 Movable board
41 Connecting part
42 Operating part
421 Part
422 Side edge part
423 Guide element
424 Projecting part
425 Restriction part
425*a* Tip end part
426 Slit
427 Engagement part
427*a* claw
428 Diameter enlarging part
428*a* Outer peripheral surface
429 Arc-shaped wall part
430 Abutting part
5 Operating member
51 (51A to 51D) Pressing part
510 Placement part
510*a* Recessed part
510*b* Abutting part
511 Side wall part
512 Leg part
513 Projection
55 Connecting element
6 Polar board
61 Base part

611 Engagement claw
612 Engagement projection
62 Connector part
621 Connecting terminal
63 Cylindrical part
631 Abutting part
631*a* Groove
632 Sliding part
64 Projecting part
64*a*, 64*b* Inclined surface
7 Substrate
71 Opening
8 Body case
A to D Tactile switch
Mk Mark
P Pin
Sp spring
X Reference axis

What is claimed is:

1. A multidirectional switch in which, when a knob in a neutral position is operated to be tilted with respect to a reference axis at a time the knob is in the neutral position, at least one pressing part positioned at an operating direction side of the knob moves in an axial direction of the reference axis to selectively close at least one switch element corresponding to the at least one pressing part, wherein:

the at least one switch element and the at least one pressing part respectively comprise the same number of the at least one switch element and the at least one pressing part that are respectively provided at predetermined intervals in a circumferential direction around the reference axis;

the at least one pressing part adjacent to each other in the circumferential direction around the reference axis are connected with each other by a flexible connecting element formed in a wave shape as viewed in a radial direction of the reference axis;

an operating part arranged to be perpendicular to the reference axis at the time the knob is in the neutral position; and a movable board that is tilted by moving the operating direction side of the knob in the operating part, in the axial direction as viewed from the reference axis when the knob is operated, wherein:

as viewed from the reference axis, the operating part is provided with at least one abutting part, which abuts on the at least one pressing part, positioned in a preset direction as the operating direction of the knob, and at least one blocking part that blocks tilting of the movable board in a direction that is not preliminarily set as the operating direction of the knob;

when the knob is operated in the direction that is not preliminarily set as the operating direction of the knob, the at least one blocking part abuts on a fixed-side stopper to block the tilting of the knob; and a guide part is provided on an abutting surface of the fixed-side stopper to guide a tilting direction of the movable board to a tilting direction corresponding to a direction that is preliminarily set as the operating direction of the knob.

2. The multidirectional switch according to claim 1, wherein:

the at least one switch element is closed at the time of being pressed in a predetermined amount toward a substrate where the at least one switch element is provided, by the at least one pressing part;

the at least one pressing part includes a contact part making contact with a surface of the switch element opposite to the substrate, and leg parts extending against the substrate through lateral sides of the at least one switch element from side edges of the contact part; and the leg parts block a movement of the contact part toward the substrate by abutment of the leg parts on the substrate when the at least one switch element is pressed toward the substrate in a predetermined amount.

3. The multidirectional switch according to claim 1, wherein:

the at least one abutting part comprise the same number of the at least one switch element and the at least one pressing part, and at least one abutting part are provided at predetermined intervals in the circumferential direction around the reference axis; and adjacent blocking parts of the at least one blocking part are provided between adjacent abutting parts of the at least one abutting part in a circumferential direction of the reference axis.

4. The multidirectional switch according to claim 3, wherein:

the stopper and the at least one blocking part are arranged to oppose to each other in the circumferential direction of the reference axis, and the at least one blocking part abuts on the stopper in the axial direction of the reference axis and the tilting of the movable member in the direction that is not preliminarily set as the operating direction of the knob is stopped, when the knob is operated in the direction that is not preliminarily set as the operating direction of the knob.

5. The multidirectional switch according to claim 4, wherein:

the stopper and the at least one blocking part are arranged so that a tip end part of the at least one blocking part and a tip end side of the stopper are opposing to each other in the circumferential direction of the reference axis, and an angle of the tip end part of the at least one blocking part is sharper than an angle in the tip end side of the stopper.

6. The multidirectional switch according to claim 1, wherein:

the stopper and the at least one blocking part are arranged to oppose to each other in the radial direction of the reference axis, and the at least one blocking part abuts on the stopper in the radial direction of the reference axis and the tilting of the movable member in the direction that is not preliminarily set as the operating direction of the knob is stopped, when the knob is operated in the direction that is not preliminarily set as the operating direction of the knob.

7. The multidirectional switch according to claim 6, wherein:

the stopper and the at least one blocking part are arranged so that a tip end part of the at least one blocking part and a tip end side of the stopper are opposing to each other in the circumferential direction of the reference axis, and an angle of the tip end part of the at least one blocking part is sharper than an angle in the tip end side of the stopper.

* * * * *